US005735094A

United States Patent [19]

Zember

[11] Patent Number: 5,735,094

[45] Date of Patent: *Apr. 7, 1998

[54] METHOD FOR PRODUCING AN ORNAMENTAL CONCRETE SURFACE

[75] Inventor: Louis F. Zember, Fallbrook, Calif.

[73] Assignee: Ultra-Tex Surfaces, Inc., Fallbrook, Calif.

[ * ] Notice: The term of this patent shall not extend beyond the expiration date of Pat. No. 5,502,941.

[21] Appl. No.: 587,541

[22] Filed: Jan. 17, 1996

Related U.S. Application Data

[63] Continuation-in-part of Ser. No. 176,945, Jan. 3, 1994, Pat. No. 5,502,941.

[51] Int. Cl.[6] ..... E04F 21/04

[52] U.S. Cl. ..... 52/314; 52/311.1; 52/315; 52/745.19; 427/282; 427/403

[58] Field of Search ..... 52/314, 311.1, 52/315, 311.3, 316, 741.41, 745.19; 427/282, 403, 262

[56] References Cited

U.S. PATENT DOCUMENTS

| | | | |
|---|---|---|---|
| 3,524,790 | 8/1970 | Mason | 52/314 X |
| 3,594,968 | 7/1971 | Johnson | 52/311.1 X |
| 3,660,214 | 5/1972 | Nichols, Jr. et al. | 52/315 X |
| 3,683,579 | 8/1972 | Beardsley | 52/311.1 X |
| 3,737,511 | 6/1973 | Dillon | 427/205 X |
| 4,054,699 | 10/1977 | Brinkley | 156/71 X |
| 4,164,598 | 8/1979 | Wilhelm | 52/314 X |
| 4,293,599 | 10/1981 | Hori et al. | 427/274 |
| 4,349,588 | 9/1982 | Schiffer | 427/403 X |
| 4,510,729 | 4/1985 | Syring | 52/311.1 X |
| 4,644,719 | 2/1987 | Salazar | 52/311.1 X |
| 4,665,673 | 5/1987 | Diana | 52/314 |
| 4,975,303 | 12/1990 | McKinnon | 437/264 X |
| 5,215,402 | 6/1993 | Stowell et al. | 404/94 X |
| 5,398,458 | 3/1995 | Henricksen et al. | 52/311.1 X |

FOREIGN PATENT DOCUMENTS

| | | |
|---|---|---|
| 3267452 | 11/1991 | Japan . |
| 1091791 | 11/1967 | United Kingdom . |

OTHER PUBLICATIONS

"Popular Mechanics" Jan. 1994, pp. 56–59.
"Classy Concrete" Berendsohn, Roy.

*Primary Examiner*—Wynn E. Wood
*Attorney, Agent, or Firm*—Wagner & Middlebrook

[57] ABSTRACT

An ornamental coating and process for applying the coating to a substrate includes mixing a first batch of liquid mortar composed of sand, cement and an aqueous solution of acrylic resin, and trowelling or spraying a first layer of the liquid mortar onto the substrate and allowing the liquid mortar to cure. A second batch of liquid mortar is mixed which is the same as the first except that it contains a color pigment contrasting with the color of the first batch. A template defining a pattern of grout lines is placed over the cured first batch and the second batch of liquid mortar is trowelled or sprayed over the first batch and the template as a second layer and allowed to cure only to the extent that the second layer is firm, but not hard. The template is then removed, removing any part of the second layer immediately above the template thus exposing lines of the cured first batch which then appear as grout lines between areas of colored mortar which appear as bricks, flagstone or tiles etc. When the second batch has completely cured, two layers of concrete sealer are applied. The same coating may be applied over a properly supported wood substrate with proper preparation. An expanded galvanized metal lath is secured to the wood. This is then covered with a cementitious base coat which is allowed to substantially cure. The described ornamental coating then is applied over the base coat.

14 Claims, 5 Drawing Sheets

FIG. 2
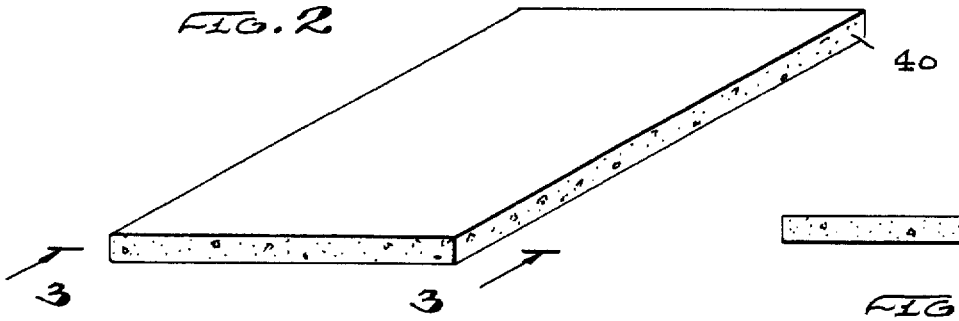
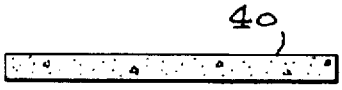
FIG. 3
FIG. 4
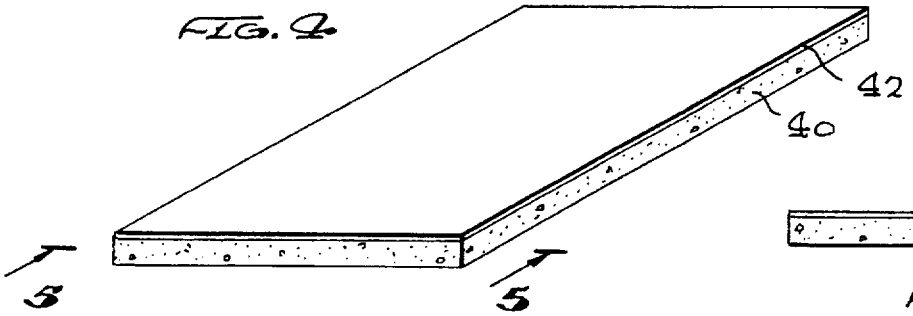
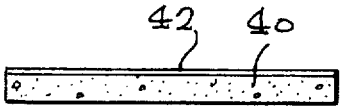
FIG. 5
FIG. 6
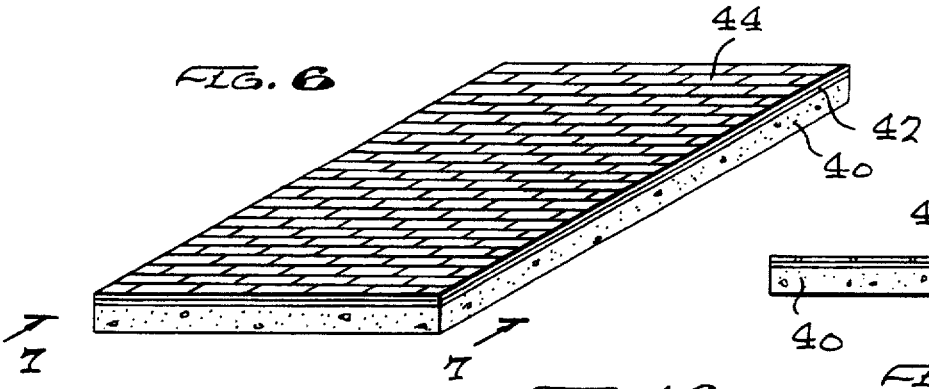
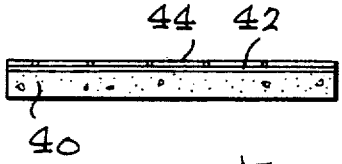
FIG. 7
FIG. 12
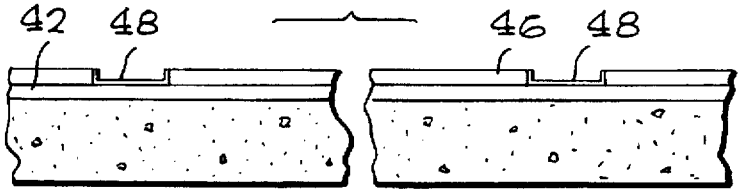

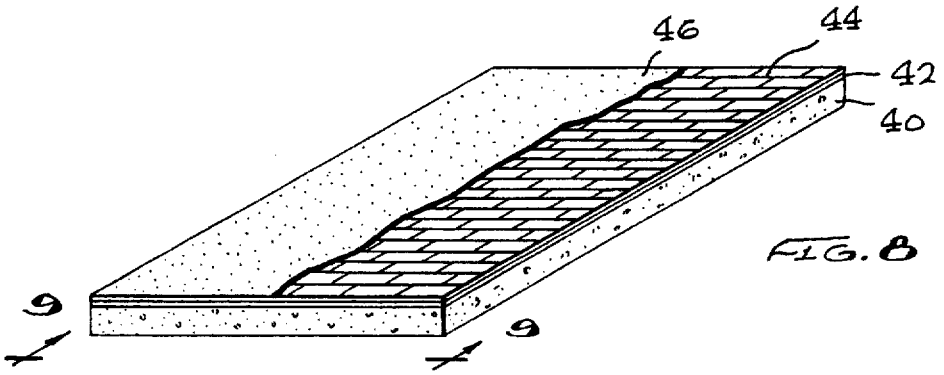
FIG. 8
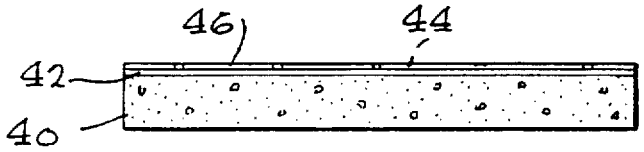
FIG. 9
FIG. 10
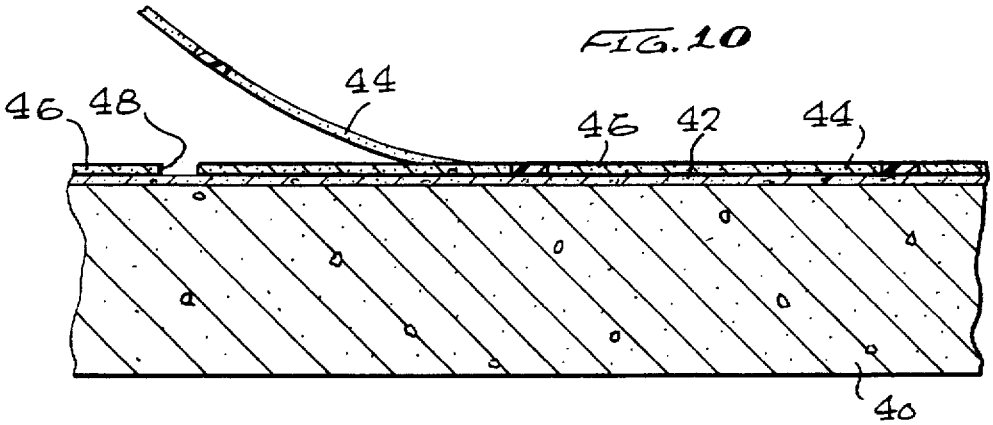
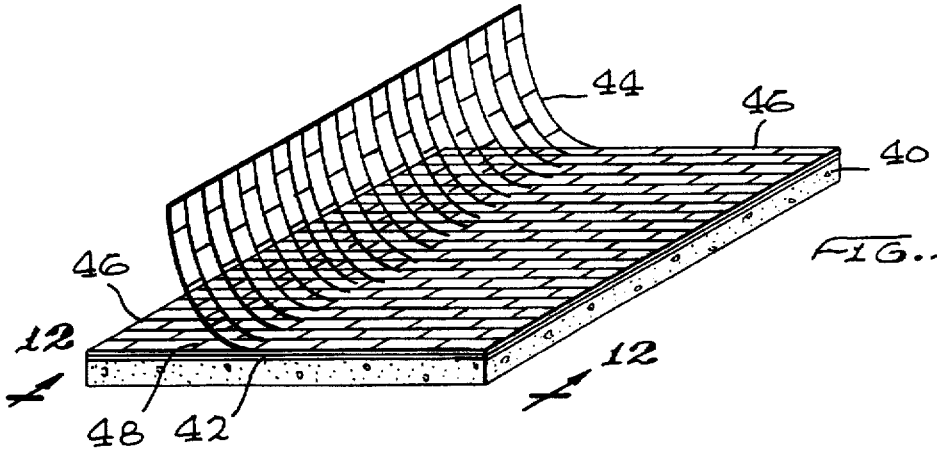
FIG. 11

METHOD FOR PRODUCING AN ORNAMENTAL CONCRETE SURFACE

This application is a continuation-in-part of application Ser. No. 08/176,945 filed on Jan. 3, 1994 now U.S. Pat. No. 5,502,941.

BACKGROUND OF THE INVENTION

This invention relates to a process for producing ornamental concrete surfaces on concrete, wood, dry wall, styrofoam, or other substances and the resulting product.

Various processes for texturing or coloring, or putting patterns on concrete surfaces are known from simple processes such as sweeping partially set concrete to produce a "broom surface" to adding coloring agents to the cement to produce colored concrete. Colored concrete is often patterned by manually imprinting a flagstone pattern, for example, into a concrete surface while it is still somewhat wet, but firm enough to retain the pattern. More elaborate surface treatments are known including embedding stones varying in size or color into concrete surfaces by means of cement or resin. Frequently patterns are created by dividing the concrete surface into areas and embedding stones, etc. of different colors and sizes into the concrete surface.

Often a concrete base is covered with cement and bricks, half bricks or flagstone are cemented to the base. This is an old and well known technique which currently is considered quite expensive as to both labor and materials required.

U.S. Pat. No. 3,737,511 to T. R. Dillon teaches a method for producing an ornamental concrete surface involving embedding attractive stone-like members on the surface with an adhesive for bonding followed by removal of forms.

Other patents directed to marble chips secured to a floor surface by means of an acrylic resin which surface may be wood or concrete are typified by U.S. Pat. Nos. 4,975,303 to G. McKinnon or 4,064,699 to J. Brinkley.

U.S. Pat. No. 3,683,579 to J. Beardsley discloses a method for producing imitation bricks on a surface with a mortar line. The method does, however, require each individual imitation brick to be nailed in place and the nail heads covered with paint.

From the foregoing, it will be apparent that most of the processes discussed above require substantial expenditures of time and materials (hence, money) and/or fail to produce a satisfactory effect from an aesthetic standpoint. Some such processes are limited to installation on essentially flat surfaces. There is a need for a technique for producing a decorative surface on a concrete or other base which has an appearance including mortar lines much like that wherein actual bricks or flagstones are inlaid into concrete or other substrate, but which is less expensive to produce. The process should be applicable to surfaces having substantial slopes such as roof coverings or which are vertical such as walls.

SUMMARY OF THE INVENTION

Applicants have provided a process and resulting product which meets the above needs in that it requires substantially less in the way of time and materials as compared to embedding actual bricks, tiles, or flagstones, etc. in concrete or other substrate, but which produces a similar appearance with simulated bricks or flagstones or other patterns and with consistent and identifiable visible grout lines. It may be applied over various surfaces and to interior or exterior walls as well as to generally flat surfaces such as wood or concrete patios.

The ornamented surface produced by the applicants' process is quite thin, being only from one-sixteenth inch to one-quarter inch thick. This makes it possible, for example, to apply this surface over a patio which is in elevation quite close to the bottom or sill of adjoining doors. If one were to want to surface such a patio with a real brick or flagstone surface, it would be necessary to remove the entire existing concrete patio to make available the required two or three inches of elevation to accommodate the thickness of the bricks or flagstones without raising the surface above the base of the door. Applicants' process produces an ornamental coating almost indistinguishable from real bricks or flagstones or other simulated products, but which could easily be installed over an existing patio without concern for exceeding the elevation of an adjoining door sill.

The ornamental concrete surface of the invention may be applied over a number of substances including adequately supported wood, metal, concrete, drywall or styrofoam.

If the substrate is wood or plywood, an expanded galvanized metal lath is stapled to the wood surface. Next, a water-proof sub-base is applied in the form of a polyacrylic cement which is trowelled over the surface to cover the lath.

If it is desired to apply the ornamental coating over an existing concrete patio, for example, any existing cracks are patched. This is preferably done by v-grooving the cracks after which the surface is etched by acid washing to promote adhesion of the ornamental surface. The surface is then neutralized with a solution of an alkaline material such as baking soda (e.g., 4 lbs of baking soda to 5 gallons of water) and washed. Following the etching and neutralizing steps, the cracks are filled with epoxy resin and an elastomeric sealant is applied, the sealant having sufficient flexibility to avoid cracking with subsequent temperature changes, etc. Fiberglass webbing is then applied over the cracks.

Over the properly prepared surface, an initial primer coat is applied, this primer coat consisting of the same adhesive acrylic resin used in subsequent steps, but diluted with 80 percent water. This primer coat must be kept moist and followed with a first mortar layer referred to as a grout layer which consists of a mixture of cement, sand and color pigment mixed to a relatively thin consistency with an aqueous solution of adhesive acrylic resin. This mixture is either sprayed on or trowelled and, if desired, colored with a color which is desired for a visible grout pattern. When this mortar layer has substantially cured, a template is laid over this first layer having a pattern of the desired grout lines such as those between bricks or flagstones. This template may be of several kinds of plastic impregnated paper such as solid bleached sulfate or chipboard, of heavy kraft paper impregnated with wax, of plastic such as mylar, or even of rubber. Most such templates are 0.022" to 0.028" thick; however, if a customer prefers a deeper grout line, the template may be doubled, giving a thickness of 0.044" to 0.056". It is preferably coated on one side with an adhesive which adheres sufficiently to hold the template in place during application of an additional mortar layer and which adheres well enough to prevent the additional mortar layer from creeping under the template. The adhesive does not create a bond which would prevent the template from being readily removed by pulling the template off the surface of the first mortar layer.

With the template securely in place, a second mortar layer is applied which is the same as the first mortar layer except that it is mixed with a contrasting color pigment to give the appearance, for example, of brick, flagstones, or other simulated product. This layer may be sprayed on or applied with a trowel to a depth of the thickness of the template or slightly greater after which it is permitted to cure or "set". The template is then removed leaving the first mortar layer visible as grout lines between remaining areas of the second layer which then appear as bricks, flagstones, tiles or whatever surface effect is established by the color and the template chosen. Following removal of the template, any chips on an edge of the second layer adjacent the grout lines can readily be repaired or "touched up" with a trowel, if necessary.

Certain artistic effects can be accomplished by applying over the second mortar layer before it cures and before the template is removed, a third mixture of grout of a color contrasting with that of the second layer, as for shading. This coat may be applied by trowelling. Or after the second mortar layer is cured, a third color mixture may be applied by spraying or by applying with a sponge dipped in a dilute solution of adhesive resin. The aesthetic effect will depend upon the artistry of the workman.

When the second mortar layer and the third coat, if any, have cured, a clear concrete sealer (a polyacrylic emulsion) is applied which is allowed to dry for at least two hours and then a second coat of clear concrete sealer is applied. When this coat has dried, the process is complete.

The above described process can also be applied to the exterior surface of tilt-up concrete wall panels. Normally such panels are formed flat on the ground so that the intended interior surface is up and available to be finished. The panel must then be turned over to apply the decorative exterior surface. It would then be turned over again to keep the decorative surface on the outside.

Where conditions permit, applicants can sometimes spray the mortar layers rather than trowelling; however, it is usually preferable to trowel the mortar. Frequently spraying cannot be used because of wind conditions resulting in overspray on adjacent areas. Once the mortar adheres to a surface, it is extremely difficult to remove.

For interior application, this same basic process is also useful for installation over drywall panels except that the initial primer coat described above is not required unless waterproofing is necessary.

In one major building project, a wood or steel frame of relatively large size (8'×15') is preassembled with insulation and a base coat which may be an acrylic resin or a glass fiber reinforced acrylic resin. Adhering to this resin is a layer of molded expanded polystyrene insulation board and a mesh layer. This technique is commercially known as an EFIS system. Over this pre-assembled panel, the decorative surface described above is applied. The frames, as decorated, are then attached as exterior wall sections to the steel skeletal supports of a building. Large numbers of such frames are used and may be combined with a number of different surface decorating patterns.

Because of the limited thickness of the mortar layers produced by the above described process, it affords a particular advantage in that, should a given coating prove unsatisfactory for aesthetic or other reasons, it can be easily covered with a new surface providing the same or different patterns and colors. Unless the panel is up on a building, this can be accomplished at similar cost to the first coating except for inherent differences in cost between patterns and differences in preparation cost. In actuality, a second surface placed over a first surface in good condition may actually cost less than the first if the first coating required a substantial preparation.

BRIEF DESCRIPTION OF THE DRAWING

FIG. 2 is a perspective drawing of a concrete substrate ready to receive applicants' ornamental surface;

FIG. 3 is a cross-section of the concrete substrate of FIG. 2;

FIG. 4 is a perspective view of the substrate of FIG. 2 with a first layer of liquid mortar applied referred to as a grout coat;

FIG. 5 is a cross-sectional drawing along lines 5—5 of the substrate of FIG. 4 showing the grout coat applied;

FIG. 6 is a perspective view of the substrate of FIGS. 4 and 5 with a template secured to the grout coat;

FIG. 7 is a sectional drawing through line 7—7 of FIG. 6;

FIG. 8 is a perspective view of the structure of FIG. 6 with a second layer of mortar applied over a portion of the template;

FIG. 9 is a cross sectional view taken along line 9—9 of FIG. 8;

FIG. 10 is a perspective view of the substrate of FIGS. 8 and 9 showing a template section in the process of being removed;

FIG. 11 is a fragmentary view of a portion of FIG. 10 on a larger scale;

FIG. 12 is a view of the cross sectional drawing of FIG. 11 with the template removed;

DESCRIPTION OF THE PREFERRED EMBODIMENT

Figure 1:
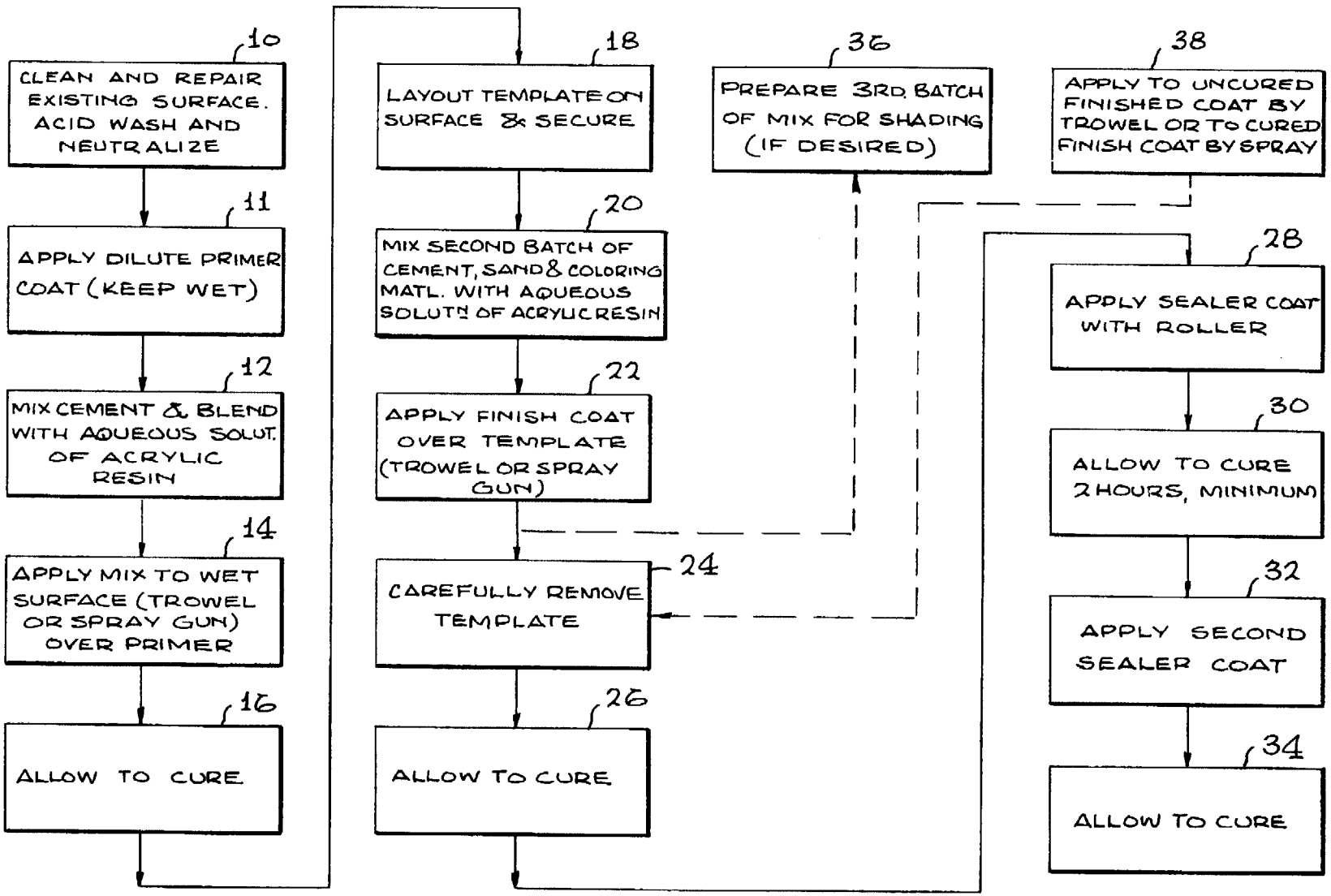
FIG. 1 is a block diagram showing the steps of the applicants' process.
Figure 13:
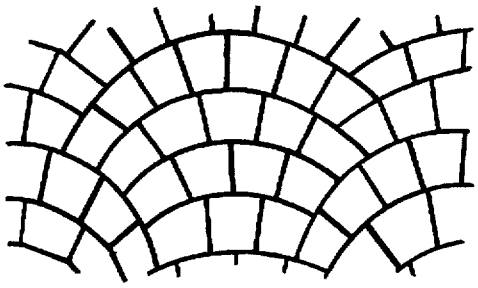
FIGS. 13–18 show some typical template patterns which may be used to create various decorative effects on the surface of a substrate.
Figure 16:
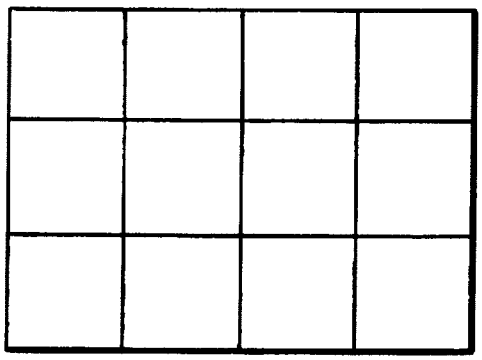
Figure 14:
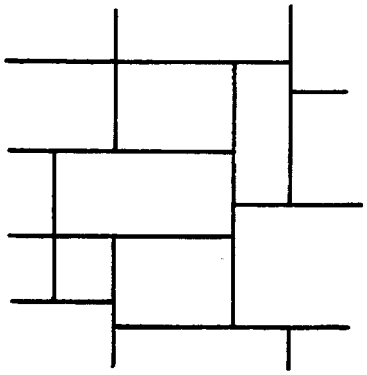
Figure 17:
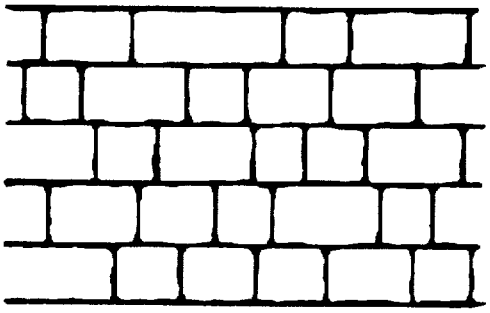
Figure 15:
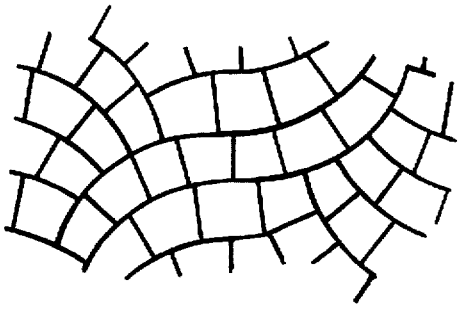
Figure 18:
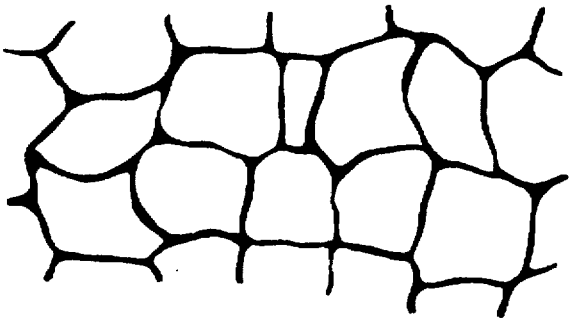

FIG. 1 is a block diagram showing, in order, the steps of applying applicants' ornamental surface to a substrate. While, as indicated above, the usual application for applicants' process would be to apply the ornamental surface to a concrete substrate such as a patio surface, it is also quite possible to apply it to a metal surface or a well supported wood surface. It may also be applied to a vertical surface, as described above.

Block 10 defines a process of repairing and cleaning a concrete surface including patching any cracks as set forth above and also acid washing to etch the surface to aid in causing the ornamental surface to adhere properly. After the acid washing step, the surface is neutralized with a baking soda solution.

After neutralizing, a primer coat 11 of dilute acrylic resin is applied to the surface which must be kept wet. The primer coat is a mixture of 20 percent acrylic resin and 80 percent water. The particular resin product recommended is identified as UT91-1 Liquid available from Ultra-Tex, P.O. Box 1537, Fallbrook, Calif. 92088.

Following this or perhaps simultaneous with the cleaning process it is necessary to prepare a mixture of cement and sand (recommended is UT91-1 powder from Ultra-Tex) and a suitable coloring agent which may be liquid or powder, if desired, to provide a color for the grout lines, which mixture is mixed with an aqueous solution of acrylic resin (UT91-1 liquid) to provide a mixture having a consistency roughly that of a milkshake. The ratio of cement and sand is approximately 50—50%. The resin solution varies from 1½ to 2 gallons per 46 lb. bag of dry cement/sand mix. It will be recognized that this mixture is substantially thinner and less viscous than the usual concrete mortar mix. This step is outlined in the block 12 and must be accomplished while the primer coat is still wet. Block 14 defines the step of applying the mix to the surface of the substrate which would preferably be done with a trowel but may also be done with a spray gun. This is considered the grout coat.

Following the application of this mixture to the surface, the mortar is allowed to cure as shown in block 16 following which the chosen template is placed on the surface and secured thereto. This template is preferably of heavy plastic impregnated paper or one of the other listed template materials. The template is coated on one side with an adhesive which is chosen because it will create a bond which is sufficient to secure the template in place during a subsequent application of mortar, but which does not create a bond so strong as to inhibit the removing of the template by peeling it away when it is desired to do so. In some cases the template may not require the adhesive.

Subsequently or simultaneously with applying of the template a second batch of mortar identical to the first batch is mixed as indicated in block 20 including again the mixture of cement, sand, color pigment contrasting with the color of the first mortar mixture, and the same aqueous solution of acrylic resin. The second batch is then applied over the substrate and over the template as indicated in block 22 by means of a trowel or spray gun and this coat is allowed to dry. After this, as shown in block 24, the template is carefully removed which removes any portion of the second batch immediately above the template and exposes the first coat of a contrasting color which defines the grout lines.

Occasionally when the template is removed there will be small chips which may also be removed from the area of the second coat which indicates the brick, tile or flagstone surface. These chips are easily repaired by means of a trowel. When the template is removed and any patching has been effected, the surface is allowed to cure as indicated by block 26 and a sealer coat is then applied, typically by means of a roller, a brush, or by spraying. As indicated by block 28 the sealer coat consists of a layer of acrylic resin which is then allowed to cure for a minimum of two hours as indicated in block 30 after which a second identical sealer coat is applied as indicated in block 32. This coating is also allowed to cure at which point the process has been completed (Block 34).

In some instances, it may be desired to prepare a third batch of mortar of the same ingredients and mixed in exactly the same proportions as the second batch, but with a third color for shading or for other decorative affects. This is indicated in block 36 which is shown as an alternate step following the application of the second batch. This third batch of mix is applied to the uncured finish coat prior to the removal of the template as shown in block 38 after which the template is removed and the surface is allowed to cure. This is indicated by the dotted line extending from block 38 to block 24. Alternatively, the third coat may be applied by spraying or with a sponge after the second coat is cured but before the sealing coat or coats. Many decorative effects are possible.

The various steps of the above process are illustrated in FIGS. 2–12 where FIG. 2 indicates a typical concrete substrate 40 which may be a patio surface and which has been cleaned, repaired, etched, and primed such that it is ready for finishing. FIG. 3 indicates a cross section of this concrete substrate. In FIG. 4 the concrete substrate 40 has been coated with the first batch of mortar 42 which is shown as a separate layer on the surface of the concrete 40.

FIG. 5 is cross-section taken along line 5—5 of FIG. 4 and shows the cross section of the concrete substrate 40 with the first mortar layer 42 applied to its surface.

FIG. 6 is a perspective view of the concrete substrate 40 having the first concrete mortar layer 42 and the template 44 installed on the surface of mortar layer 42. In this particular case, the template is shown as having a brick pattern; obviously, any of several of the other patterns such as those shown in FIGS. 13–18 may be used. This template 44, as indicated above, is preferably of heavy plastic impregnated paper having an adhesive layer which attaches it to the surface of layer 42 firmly but not so firmly that it cannot be so easily pulled up and removed. This adhesive is normally covered with a peel-off backing which is removed prior to installing of the template, after which the template is secured to the surface 42.

FIG. 7 is a cross section taken along line 7—7 of FIG. 6 and shows the concrete substrate 40, the initial mortar or grout layer 42 and template 44.

FIG. 8 shows a perspective view of substrate 40 with the grout layer 42, the template 44 and the second mortar layer 46 partially installed over the template 44.

FIG. 9 is a cross sectional view taken along section 9—9 of FIG. 8 and showing the substrate 40, the initial mortar layer 42, the edges of template 44 and also the layer 46 which is shown partially covering the template 44.

FIG. 10 is a perspective view of the concrete substrate 40 with layer 42, template 44 and second layer 46 shown and with template 44 shown in the process of being removed from the surface thus carrying off any portion of layer 46 which is immediately above the template exposing the grout lines 48 which are part of the first mortar layer 42.

FIG. 11 is an enlarged view of a portion of FIG. 10 showing the respective layers of mortar and the template 44 in the process of being removed as described.

FIG. 12 is a view of a portion of FIG. 11 in which the template 44 has been removed leaving the separate areas 46 of the second mortar layer separated from each other with the grout lines 48 from the layer 42 visible between the areas.

In addition to the brick pattern shown in FIGS. 6, 8 and 10 many other patterns of template may be used, some of which may include tile and flagstone patterns shown in FIGS. 13–18.

Figure 19:
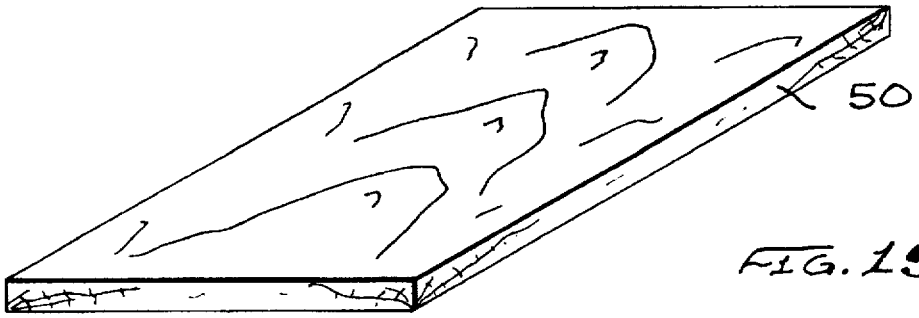
FIG. 19 is a perspective drawing of a wood substrate which is to be coated with our process.

FIG. 19 is a perspective drawing showing a wood substrate 50 prepared to receive our ornamental concrete surface.

Figure 20:
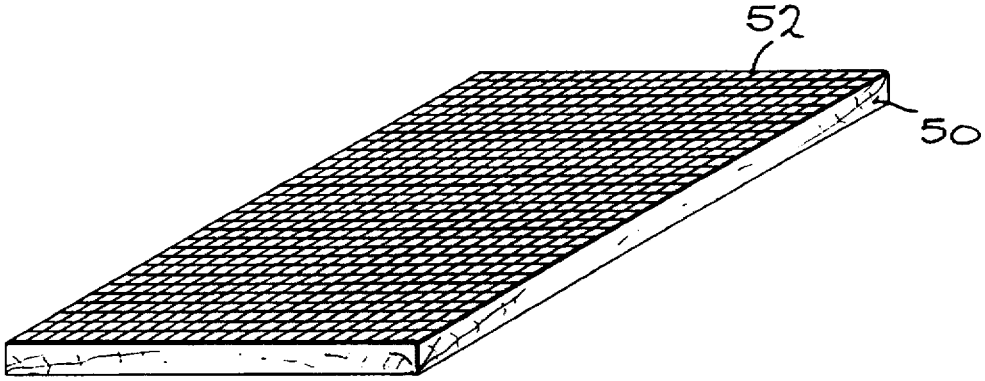
FIG. 20 is a perspective drawing of the wood substrate of FIG. 19 with a layer of expanded galvanized metal lath attached.

FIG. 20 is a perspective drawing similar to FIG. 19 showing an expanded galvanized metal lath 52 secured to the substrate 50.

Figure 21:
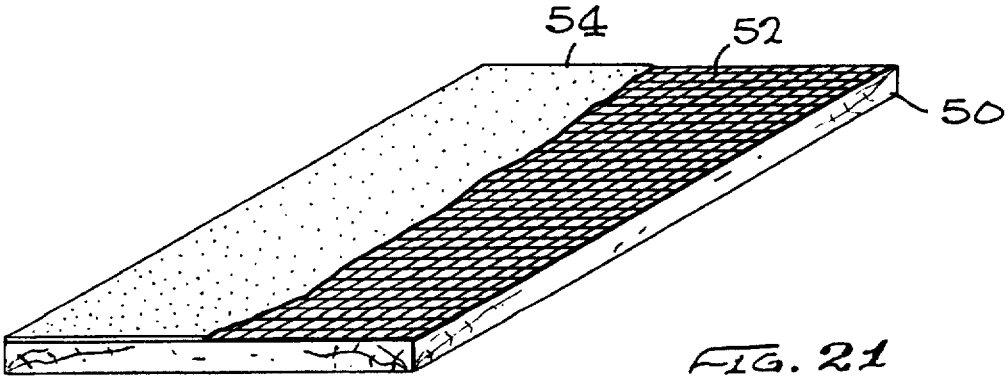
FIG. 21 is a perspective drawing of the wood substrate of FIGS. 19 and 20 with the expanded metal lath partially covered with a waterproof coating of portland cement, sand, and a polyacrylic emulsion.

FIG. 21 is a perspective drawing showing a cementitious layer 54 which is trowelled over and partially covers the substrate 50 and expanded galvanized metal lath 52. The cementitious layer 54 is applied to a depth which completely covers the metal lath layer 52. Layer 54 is composed of a mixture of portland cement, sand, and a poly acrylic emulsion. Following the waterproof application of the cementitious layer 54, the ornamental concrete surface is applied as set forth above including the first mortar layer, application of the template, application of the second mortar layer, application of the third mortar layer, if any, removal of the template and application of two coats of concrete sealer.

The above described embodiments of the present invention are merely descriptive of its principles and are not to be considered limiting. The scope of the present invention instead shall be determined from the scope of the following claims including their equivalents.

What is claimed is:

1. A process of covering a substrate with a decorative surface comprising:

priming said substrate with a dilute aqueous solution of adhesive resin;

mixing a first batch of cement, sand, and an aqueous solution of adhesive resin to create a liquid mortar;

applying the mortar on the substrate while said priming solution is wet to form a first layer on the substrate;

allowing the mortar to cure on the substrate; providing a flexible template panel having a pattern of desired grout lines, an adhesive layer and a backing over said adhesive layer;

peeling said backing layer away from said template panel and securing the template to said first layer;

mixing a second batch of cement, sand, color pigment, and an aqueous solution of adhesive resin to create a second batch of liquid mortar contrasting in color with said first batch;

applying said second batch over said first batch to at least approximately the level of the top of said template to form a second layer and allowing said second layer to dry;

removing said template to expose said first layer under said template;

allowing said second batch to finish curing; and applying a sealer coat of polyacrylic cement covering said first and second layers.

2. The process of claim 1 wherein prior to applying said primer, said substrate is acid washed and then neutralized with an alkaline solution.

3. The process of claim 1 wherein said substrate is of wood and prior to applying said first layer, a layer of metal lath is fastened to said wood substrate, and a waterproof cementitious layer is applied over said metal lath.

4. The process of claim 1 wherein a second sealer coat is applied over said first sealer coat.

5. A process for coating a substrate with a decorative surface comprising priming said surface with a dilute aqueous solution of adhesive resin, mixing a first batch of liquid mortar consisting of a mixture of cement, sand and an aqueous solution of adhesive resin and applying a first layer of said liquid mortar to said surface while said priming solution is wet;

allowing said first layer to cure;

providing a flexible plastic impregnated template having a pattern of desired grout lines, an adhesive layer and a backing layer;

removing said backing layer to expose said adhesive layer;

securing said template to said first layer;

mixing a second batch of cement, sand and an aqueous solution of adhesive resin including also a color pigment contrasting with the color of said first batch;

applying a second layer of said second batch of liquid mortar over said first layer and allowing said second layer to fully dry;

removing said template with any part of said second layer immediately above said template, and allowing said second layer to finish curing; and applying a coat of concrete sealer material over said first and second mortar layers.

6. The process of claim 5 wherein a third batch of liquid mortar is prepared including color pigment contrasting with the color of said second batch and said third batch is selectively applied over said second layer before said second batch has finished curing and before said template is removed.

7. The process of claim 5 wherein the third batch of liquid mortar is prepared including color pigment contrasting with the color of said second batch and said third batch is selectively applied over said second layer after said second batch has finished curing.

8. The process of claim 5 wherein said first batch also includes color pigment.

9. A cementitious ornamental surface placed over a substrate comprising a primer coat of a dilute aqueous solution of adhesive resin, a first mortar layer formed of a mixture of cement, sand, and an aqueous solution of adhesive resin applied over said primer coat while said coat is still wet and allowed to cure;

a pattern of desired grout lines formed by a removable plastic impregnated paper template panel placed over said first mortar layer, said template panel having a width at least greater than the width of the largest spaces between two of said grout lines;

a second mortar layer formed of a mixture of cement, sand, color pigment and an aqueous solution of adhesive resin applied over said first mortar layer and said removable template and allowed to cure only until firm, after which said template is removed and said second mortar layer is permitted to cure; and at least one coat of concrete sealer material applied over said first and second mortar layers.

10. A cementitious ornamental surface as claimed in claim 9 wherein said substrate is of wood, and before said first mortar layer is applied, a metal lath is secured to said substrate, and a waterproof cementitious layer is applied over said substrate and said lath.

11. A cementitious ornamental surface as claimed in claim 9 wherein said removable template is of plastic impregnated paper having a peelable adhesive layer on one side.

12. An ornamental surface as claimed in claim 10 wherein the mixture of said first mortar layer includes a color pigment.

13. An ornamental surface as claimed in claim 9 wherein two coats of sealer are applied over said first and second layers.

14. An ornamental surface as claimed in claim 10 including a third mortar layer formed of the same materials as said second mortar layer but of a contrasting color, and selectively applied over the surface of said second mortar layer.

* * * * *